US006632006B1

(12) United States Patent
Rippel et al.

(10) Patent No.: US 6,632,006 B1
(45) Date of Patent: Oct. 14, 2003

(54) RECESSED WALL WASH LIGHT FIXTURE

(75) Inventors: Graham M. Rippel, South Easton, MA (US); Daniel F. Francis, Warren, RI (US); Brian Roberge, Allston, MA (US); Erik B. Thomas, Little Compton, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/715,846

(22) Filed: Nov. 17, 2000

(51) Int. Cl.[7] ..... F21S 1/06

(52) U.S. Cl. ..... 362/366; 362/365; 362/364; 362/147; 362/148; 362/373

(58) Field of Search ..... 362/147, 148, 362/150, 294, 364, 365, 373, 366

(56) References Cited

U.S. PATENT DOCUMENTS 5,562,343 A * 10/1996 Chan et al. ..... 362/365
6,095,669 A * 8/2000 Cho ..... 362/365
6,095,671 A * 8/2000 Hutain ..... 362/373
6,554,457 B1 * 4/2003 Platt ..... 362/365

* cited by examiner

*Primary Examiner*—Thomas M. Sember
*Assistant Examiner*—Anabel Ton
(74) *Attorney, Agent, or Firm*—Jeffrey A. Haeberlin; Middleton Reutlinger

(57) ABSTRACT

A finishing section of a recessed wall wash light fixture has a heat conducting side wall. The inner surface of the side wall has a reflective finish. A lamp is non-centrally aligned within the finishing section. The reflective sides cooperate with the off axis location of the lamp to operate as a kick reflector to kick a portion of the light emitted outward from the fixture at high angles to illuminate a nearby wall close to the ceiling line. The finishing section functions as a lamp support, heat shield and kick reflector reducing the number of parts and complexity of assembly typical of wall wash light fixtures. The finishing section is mounted substantially within a rough-in section housing. An aperture cone section, lens, hinge and bias mechanism, and rotatable collar improve performance and functionality of the fixture.

24 Claims, 4 Drawing Sheets

RECESSED WALL WASH LIGHT FIXTURE

BACKGROUND OF THE INVENTION

1. Field of the Invention

The present invention relates to recessed wall wash light fixtures, and in particular to a finishing section for controlling the heat and light generated by a lamp in a recessed light fixture.

2. Description of Prior Art

Recessed light fixtures are popular design choices, providing direct illumination to a workspace while concealing the lamp, internal components (sockets, wiring, junction boxes, ballasts, temperature switches, etc.) and mounting hardware of the fixture behind the plane of the mounting surface, usually a ceiling. With the addition of specialized optics, recessed light fixtures can achieve effects such as wall washing and accent lighting.

Recessed wall wash light fixtures are designed to project light from a recessed ceiling fixture located close to a wall at a range of angles to illuminate the wall from the ceiling to the floor. This, in effect, "washes" the wall with light. Since the lamp in such a fixture is recessed in the ceiling, the wall wash effect requires light from the lamp to be directed downwardly and outwardly in the direction of the wall. These functions are generally achieved through the use of kick reflectors and lenses. However, complex optical systems requiring multiple component pieces to achieve the desired effect increase manufacturing and assembly costs, and create potential performance problems from improper installation.

For example, prior art wall wash fixtures are shown in FIG. 1 and FIG. 2. In FIG. 1, the wall wash effect is created by placing a concave kick reflector 1 behind a window 2 cut out of a standard downlight reflector cone 3. The reflector cone 3 also serves to support the bulb and socket cup assembly 4.

In FIG. 2, the wall wash effect is created through the use of a kick reflector 5 in cooperation with a lamp 6 and a lens 7. The lamp 6 is held in place by a support arm 8. The entire assembly in contained within a housing 9.

Manufacturers of recessed light fixtures generally offer a complete product line including downlight, wall wash and accent type fixtures in multiple sizes and utilizing various lamp types and wattages. Each fixture configuration constitutes a discreet product requiring a unique set of components.

Ceiling mounted recessed fixtures are generally comprised of a rough-in section and a finishing section. The rough-in section, so called because it is installed during construction and not seen from the room side of the fixture once the ceiling is installed, serves as a frame to support the components of the fixture. It is mounted between ceiling joists or other structural members. Additionally, the rough-in section may provide the structure for mounting a junction box for attachment of the fixture to building power, wiring harness for internal wiring within the light fixture, and any additional ballast or other components. The finishing section, installed after construction of the ceiling is completed, contains the optics of the fixture, including any reflectors, baffles, or lenses.

Building and fire codes also require that ceiling mounted fixtures provide a barrier to air flow and the spread of fire. Some building codes, such as the Model Energy Code, mandate that air exchange between the room side and ceiling side of the fixture be virtually eliminated for energy conservation purposes. Thus, it is common for a rough-in section to have a housing surrounding the finishing section, restricting the escape of light and heat therefrom.

Since all lamps generate heat, an issue that exists with any light fixture is the dissipation of heat. However, since recessed ceiling light fixtures must often share the mounting space with insulation, electrical wiring, communications cabling and materials in storage, heat is an even greater concern. Safety concerns generally limit fixture temperatures in contact or within ½ inch from combustible materials to a temperature of 90 degrees Celsius, or less.

Wall wash fixture designs strive to maximize usable lumen output from the fixture due to the losses in wall wash fixture optics. Generally, lumen output is proportional to lamp wattage. However, higher lamp wattage also creates higher heat generation. Further contributing to heat generation in wall wash fixtures is the phenomenon of "spill light" (generated light which is trapped in the fixture). Both spill light and losses due to the fixture optics create additional heat in the fixture as the light energy is converted into heat. Thus, wall wash fixture designers must balance lumen output (lamp wattage) within the thermal limits of the fixture and the environment in which the fixture is being installed.

SUMMARY OF THE INVENTION

It is an object of the present invention to provide a recessed wall wash light fixture having a unitary finishing section acting as a lamp support, heat shield and kick reflector.

It is a further object of the invention to provide a recessed wall wash light fixture which does not require a separate kick reflector to achieve the desired effect.

It is also an object of the present invention to provide a recessed wall wash light fixture having a modular finish section which is interchangeable with finish sections for creating other effects, including general downlighting and accent lighting.

The present invention provides a recessed wall wash light fixture having a rough-in section and a finishing section. The rough-in section has a housing having a bottom with a hole for receiving the finishing section. The finishing section is composed of a heat conducting side wall having a reflective inner surface and supporting a lamp. The lamp is non-centrally aligned and disposed within the finishing section such that a portion of the light emitted from the lamp is reflected off of the reflective inner surface of the side wall. Further, heat and any spill light generated by the lamp will also be controlled by the finishing section.

Manufacturing and use benefits may be achieved by utilizing a cylindrically shaped finishing section.

The finishing section may have a top with a ventilating hole for further controlling and directing heat and spill light within the fixture. The top may further be dome shaped.

The mechanism for the side wall to support the lamp may include a lamp housing supporting the lamp, and a bracket attaching the lamp housing to the side wall.

In order to improve dispersion of the light washing the wall surface, the reflective finish on the inner surface of the side walls may be a semi-diffused reflective finish.

Further, to improve the appearance of the fixture from the room, a frustoconically shaped aperture cone section may be utilized in conjunction with the finishing section. By cutting the top opening, defined by a top rim of the aperture cone section, at an angle to the bottom opening, defined by a bottom rim, a non-centrally aligned top opening may be created to align with the non-centrally aligned lamp of the fixture. Further, this aperture cone section can cooperate with the lamp and reflective inner surface of the side wall to direct light toward the wall. Additionally, a lens may be placed over the top opening to direct light toward the wall or diffuse the directed light for a more even distribution of light on the wall. The aperture cone section may also have a trim flange extending radially outward from the bottom rim, in order to cover any gap that may exist between an opening to be made in a ceiling and the fixture.

To aid in installation and maintenance, the cone section may be attached to the finishing section by a hinge and spring arm.

For adjustment purposes, a collar assembly may be rotatably coupled around the lower portion of the finishing section to allow the finishing section to rotate in the ceiling opening.

The finishing section may be made of an aluminum material.

Further, a placing an additional outer housing around the rough-in section housing, the fixture may be adapted for use in contact with insulation.

DETAILED DESCRIPTION OF THE PREFERRED EMBODIMENT

Figure 3:
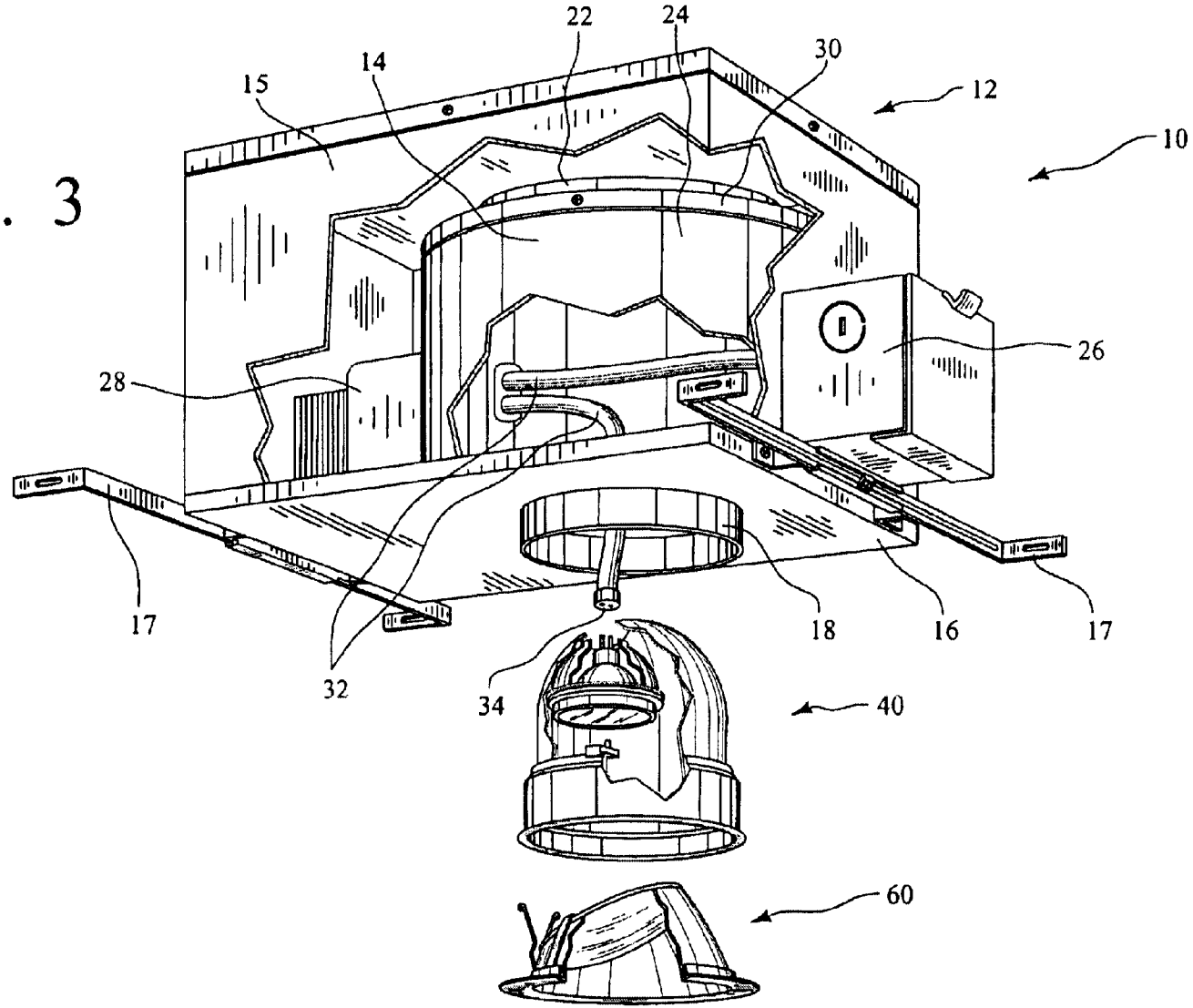
FIG. 3 is an exploded perspective view with selected portions cut away of the preferred embodiment of the present invention.

A preferred embodiment of a recessed wall wash light fixture of the present invention is shown in FIG. 3. Recessed wall wash light fixture 10 has a rough-in section 12 and a finishing section 40.

Figure 1:
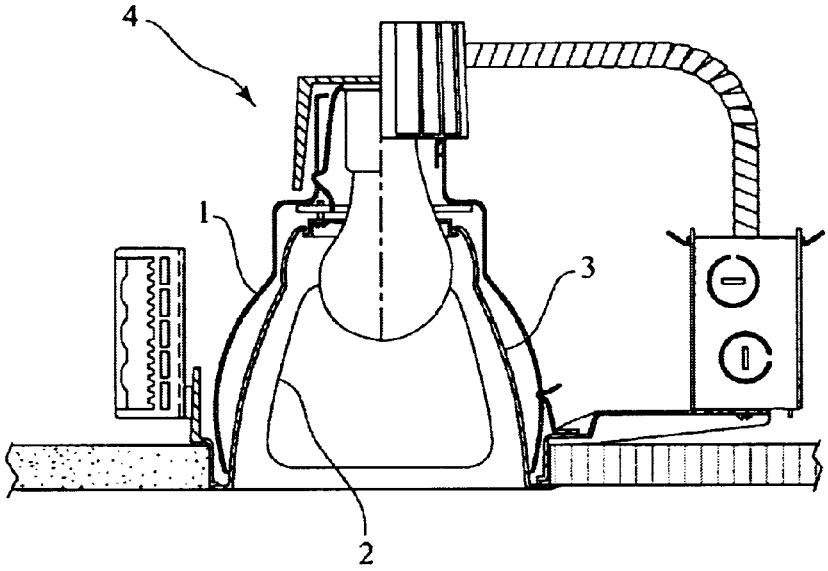
FIG. 1 PRIOR ART
FIG. 1 is a side view with selected portions cut away of a prior art device.

The rough-in section 12 of the preferred embodiment is comprised of a rough-in section housing 14 and an insulation contact housing 15. The fixture 10 as shown in FIG. 1 is designed for use in insulation contact (IC) environments and provides a barrier between any insulation and the rough-in section housing 14, and also provides a large volume of air within the insulation contact housing 15 for the dissipation of heat generated within the fixture 10.

Mounting bars 17 are provided for attaching the rough-in section 12 to ceiling support structures, such as joists or inverted T-bar grid members (support structures not shown).

It is important to note that the rough-in section 12 may only consist of rough-in section housing 14 when the fixture 10 is used in non-insulation contact (Non-IC) environments. In such an event, the mounting bars 17 would be attached directly to the rough-in section housing 14.

As shown in FIG. 3, the rough-in section housing 14 and the insulation contact housing 15 share a common bottom 16 having an opening defined by lip 18.

Figure 5:
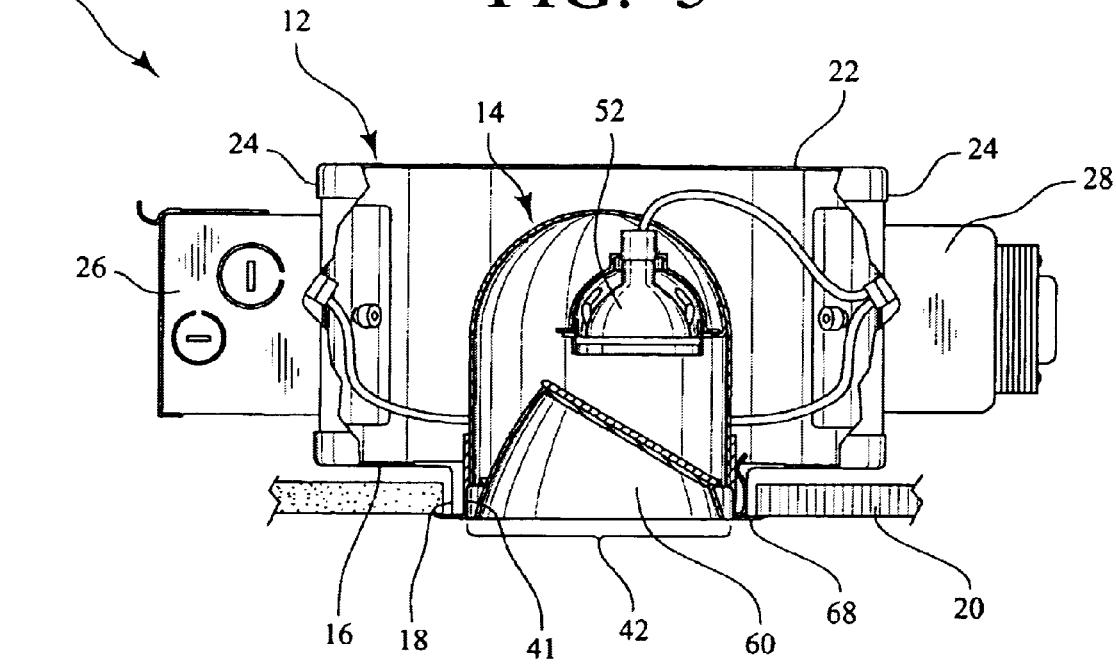
FIG. 5 is a side view with selected portions cut away of the device of FIG. 3.

As shown in FIG. 5 lip 18 is sized to fit through a light fixture opening in a ceiling 20.

Rough-in section housing 14 also has a top 22 and sides 24 extending between the bottom 16 and top 22. As shown in FIGS. 3 and 5, sides 24 may also support a junction box 26 and other auxiliary equipment 28, such as a ballast or a transformer. In the preferred embodiment, rough-in section housing sides 24 are cylindrically shaped and top 22 may have a lip 30 which fits over sides 24 to secure the top 22 to the sides 24.

A wiring harness 32 is contained within the rough-in section housing 14 for interconnecting external power through the junction box 26 to the auxiliary equipment 28 to the lamp socket 34 on the end of the harness 32.

Figure 4:
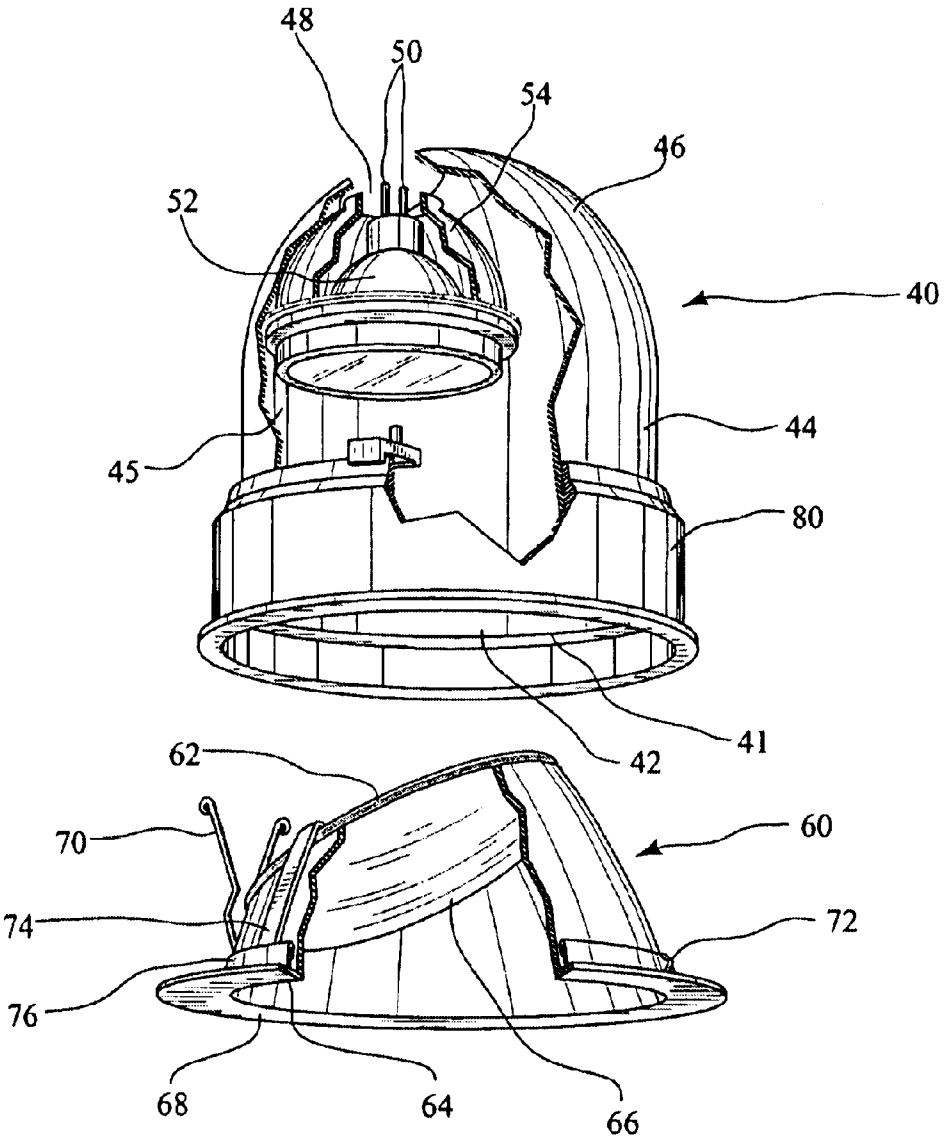
FIG. 4 is an enlarged exploded perspective view with selected portions cut away of the device of FIG. 3.

As best shown in FIG. 4, finishing section 40 has a cylindrical heat conducting side wall 44. Finishing section side wall has a bottom rim 41 defining a light exit aperture 42.

The finishing section 40 of the preferred embodiment further has a dome shaped top 46. The top 46 has a ventilation hole 48 which also provides access to connect terminals 50 of lamp 52 to lamp socket 34.

In the preferred embodiment, the internal surface of the finishing section wall 44 is finished to provide a semi-diffuse reflective surface. However, other finishes are certainly contemplated within the spirit and scope of the claimed invention.

The lamp 52 is contained within lamp housing 54, which, in turn, is attached to the finishing section 40 by a bracket (not shown). The lamp 52 is positioned off the vertical axis of the finishing section 40 in a non-centrally aligned manner. Thus, the reflective surface of the side wall 44 cooperates with the off axis location of the lamp 52 to operate as a kick reflector 45 to kick a portion of the light emitted outward from the fixture at high angles to illuminate a nearby wall close to the ceiling line. Other light not exiting the aperture 42 directly may be reflected around the reflective surface of the side wall 44 until it either exits the finish section 40 or is converted to As heat as spill light.

Figure 6:
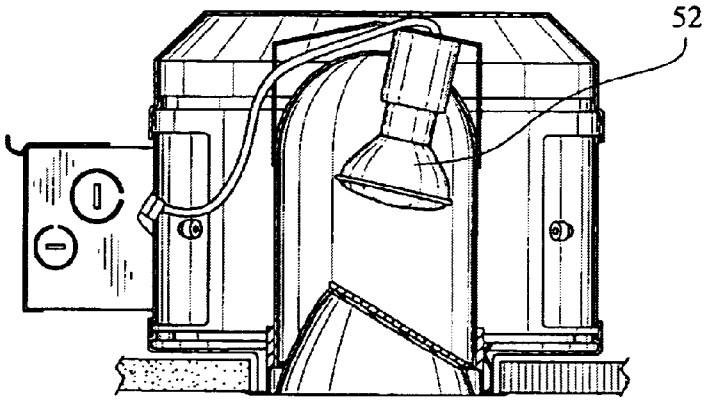
FIG. 6 is a side view with selected portions cut away of another embodiment of the present invention.

In the preferred embodiment, the lamp 52 is a 75 watt MR16 type multi-faceted reflector low voltage halogen lamp. As shown in FIG. 6, additional embodiments utilize PAR 20/PAR 16 (parabolic aluminized reflector) type lamps. However other types of lamps, such as standard "A" lamps, may be utilized within the scope of the invention.

In the preferred embodiment, finishing section 40 is made of an aluminum material which is capable of supporting the lamp 52, conducting heat generated by the lamp 52, and being finished to provide a reflective surface to act as a kick reflector for the fixture. This combination reduces the number of parts and complexity of assembly typical of wall wash light fixtures while providing heat-shielding advantages.

As also shown in FIG. 4, a frustoconical aperture cone section 60 may be added to the finishing section 40. The aperture cone section 60 of the preferred embodiment has a top rim 62 defining a top opening and a bottom rim 64 defining a bottom opening. Aperture cone section 60 fits in finishing section light exit aperture 42, as shown in FIG. 3.

Figure 2:
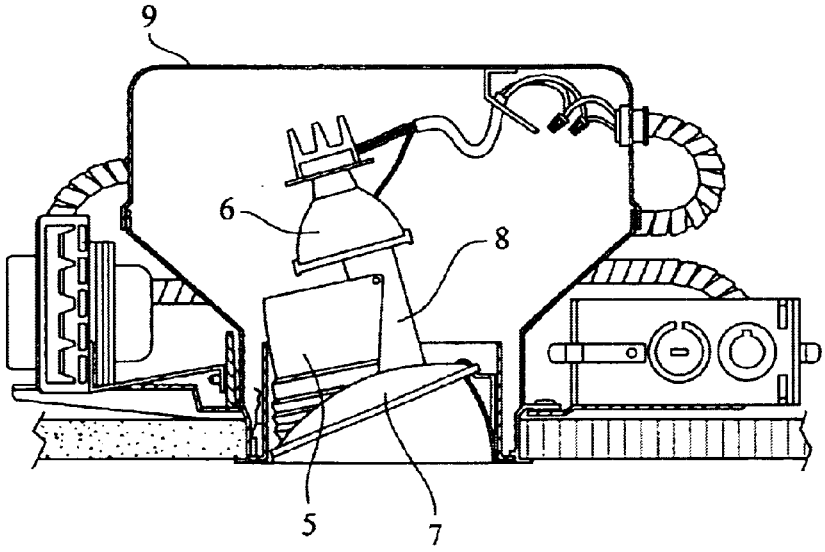
FIG. 2 PRIOR ART
FIG. 2 is a side view with selected portions cut away of a prior art device.

FIG. 2 further shows that, in the preferred embodiment, aperture cone section top rim 62 and top opening lie in a plane which is at an angle to the plane of the bottom rim 64 and bottom opening. Thus, aperture cone section 60 may be oriented such the its top opening is in alignment with the lamp 52.

In order to further direct and diffuse the light output from the lamp 52, a directional spread lens 66 may be installed over the top opening.

To cover any gap that may exist between the ceiling 20 and fixture 10, aperture cone section 60 is provided with a trim flange 68 which extends radially outward from the bottom rim 64.

In the preferred embodiment, aperture cone section 60 is attached to the finishing section 40 through a hinge mechanism 70 and a spring arm 72 which provides a bias, when installed, between the aperture cone section 60 and the finishing section 40. Hinge mechanism 70 provides a fixed point of attachment between the finishing section 40 and the aperture cone section 60 so that the aperture cone section 60 is properly aligned with the finishing section 40 and the lamp 52.

Lens 66 is held to aperture cone section 60 by a spring extension 74 attached to a ring 76 around the outer edge of bottom rim 64. Spring arm 72 is also attached to ring 76.

An additional feature of the preferred embodiment, as shown in FIG. 4, is a collar 80 which is rotatably coupled to finishing section 40 around the lower outer portion of the finishing section sides 44. Thus, the finishing section 40 and the aperture cone 60 may be rotated in collar 80 once they are installed in rough-in section 12 in order to aim or adjust the light output from the fixture 10 toward an nearby wall.

Thus, the recessed wall wash light fixture 10 of the preferred embodiment controls both the light and heat generated by a lamp 52 by utilizing a unique finishing section 40 having heat conducting side wall 44 which functions as a heat shield, a lamp support, and a kick reflector in a single assembly.

The modular design allows finishing sections for other types of downlight fixtures to be interchanged within the same rough-in section.

This detailed description is given primarily for clearness of understanding and no unnecessary limitations are to be understood therefrom for modifications will become obvious to those skilled in the art upon reading this disclosure and may be made without departing from the spirit of the present invention and scope of the appended claims.

What is claimed is:

1. A recessed wall wash light fixture comprising:

a rough-in section housing having a bottom, said bottom having an opening;

a finishing section housing having a substantially cylindrical heat conducting side wall and a top, said side wall having a reflective inner surface and a bottom rim, said bottom rim defining a light exit aperture, said top having a heat ventilating hole therein, said finishing section mounted substantially within said rough-in section housing; and a non-centrally aligned lamp disposed within said finishing section and offset from said light exit aperture, said lamp also supported by said finishing section, whereby a portion of the light emitted from said lamp is reflected oft of said side wall.

2. The recessed wall wash light fixture of claim 1 wherein said top is dome shaped.

3. The recessed wall wash light fixture of claim 1 said finishing section housing further comprising a bracket attached to said side wall and a lamp housing attached to said bracket, said lamp housing supporting said lamp.

4. A recessed wall wash light fixture comprising:

a rough-in section housing having a bottom, said bottom having an opening;

a finishing section housing having a substantially cylindrical heat conducting side wall, said side wall having a reflective inner surface and a bottom rim, said reflective inner surface being a semi-diffused reflective surface, said bottom rim defining a light exit aperture, said finishing section mounted substantially within said rough-in section housing; and a non-centrally aligned lamp disposed within said finishing section and offset from said light exit aperture, said lamp also supported by said finishing section, whereby a portion of the light emitted from said lamp is reflected off of said side wall.

5. A recessed wall wash light fixture comprising;

a rough-in section housing having a bottom, said bottom having an opening;

a finishing section housing having a substantially cylindrical heat conducting side wall and a frustoconical aperture cone section, said side wall having a reflective inner surface and a bottom rim, said bottom rim defining a light exit aperture, said aperture cone section being received within said finishing section, said finishing section mounted substantially within said rough-in section housing; and a non-centrally aligned lamp disposed within said finishing section and offset from said light exit aperture, said lamp also supported by said finishing section, whereby a portion of the light emitted from said lamp is reflected off of said side wall.

6. The recessed wall wash light fixture of claim 5, said aperture cone section having a top rim defining a top opening and a bottom rim defining a bottom opening, said aperture cone section top opening lying in a plane being at an angle to the plane of the aperture cone section bottom opening.

7. The recessed wall wash light fixture of claim 6, said aperture cone section further comprising a lens, said lens covering said cone section top opening.

8. The recessed wall wash light fixture of claim 5, said aperture cone section further comprising a trim flange extending radially outward from said aperture cone section bottom rim.

9. The recessed wall wash light fixture of claim 5, said aperture cone section further comprising a hinge mechanism attaching said aperture cone section to said finishing section housing.

10. The recessed wall wash light fixture of claim 9, further comprising at least one biasing mechanism in biasing contact with said aperture cone section and said finishing section housing.

11. The recessed wall wash light fixture of claim 1 further comprising a collar around the lower outer portion of said finishing section housing, said collar being rotatably coupled to said finishing section housing.

12. The recessed wall wash light fixture of claim 1 wherein said finishing section side wall is made of an aluminum material.

13. The recessed wall wash light fixture of claim 1, further comprising an insulation contact housing enclosing said rough-in section housing.

14. A recessed wall wash light fixture comprising:

a finishing section housing having a cylindrical heal conducting side wall, a top and a vertically oriented axis, said side wall having an inner surface and a bottom rim, said inner surface having a reflective finish, said bottom rim defining a light exit aperture, said top having a beat ventilating hole therein; and a lamp disposed within said finishing section and offset from said light exit aperture, said lamp being positioned off said vertical axis of said finishing section housing, said lamp being supported by said finishing section housing.

15. The recessed wall wash light fixture of claim 14 wherein said top is dome shaped.

16. The recessed wall wash light fixture of claim 14, said finishing section housing further comprising a bracket attached to said side wall and a lamp housing attached to said bracket, said lamp housing supporting said lamp.

17. A recessed wall wash light fixture comprising:

a finishing section housing having a cylindrical heat conducting side wall and a vertically oriented axis, said side wall having an inner surface and a bottom rim, said inner surface having a reflective finish, said bottom rim defining a light exit aperture;

a lamp disposed within said finishing section and offset from said light exit aperture, said lamp being positioned off said vertical axis of said finishing section housing, said lamp being supported by said finishing section housing; and a frustoconical aperture cone section having a top rim defining a top opening and a bottom,rim defining a bottom opening, said aperture cone section being received within said finishing section, said aperture cone section top opening lying in a plane being at an angle to the plane of the aperture cone section bottom opening.

18. The recessed wall wash light fixture of claim 17, said aperture cone section further comprising a lens covering the cone section top opening.

19. The recessed wall wash light fixture of claim 17, said aperture cone section further comprising a trim flange extending radially outward from said aperture cone section bottom rim.

20. The recessed wall wash light fixture of claim 17, said aperture cone section further comprising a hinge mechanism attaching said aperture cone section to said finishing section housing, and at least one biasing mechanism in biasing contact with said aperture cone section and said finishing section housing at an opposing position to said hinge mechanism.

21. The recessed wall wash light fixture of claim 14, further comprising a collar around the lower outer portion of said finishing section housing side wall, said collar being rotatably coupled to said finishing section housing.

22. The recessed wall wash light fixture of claim 14 wherein said finishing section housing is made of an aluminum material.

23. The recessed wall wash light fixture of claim 14 further comprising a rough-in section housing a having a bottom, a top, and sides extending between said bottom and top, said rough-in section housing bottom having an opening, said finishing section housing being mounted substantially within said rough-in section housing through said rough-in section housing bottom opening.

24. The recessed wall wash light fixture of claim 22 further comprising an additional insulation contact housing enclosing said rough-in section housing.

* * * * *

UNITED STATES PATENT AND TRADEMARK OFFICE

CERTIFICATE OF CORRECTION

PATENT NO. : 6,632,006 B1
APPLICATION NO. : 09/715846
DATED : October 14, 2003
INVENTOR(S) : Graham Rippel et al.

It is certified that error appears in the above-identified patent and that said Letters Patent is hereby corrected as shown below:

Col. 1 in Claim 1, line 55, please change "oft" to --off--.

Col. 6 in Claim 14, line 60, please change "heal" to --heat--.

Col. 6 in Claim 14, line 65, please change "beat" to --heat--.

Col. 7 in Claim 17, line 13, please correct the phrase "bottom,rim" to --bottom rim--.

Col. 8 in Claim 23, line 20, please correct the phrase "housing a having a" to --housing having a--.

Signed and Sealed this

Sixth Day of October, 2009

David J. Kappos

David J. Kappos
*Director of the United States Patent and Trademark Office*